US009746820B2

(12) United States Patent
Matsuno

(10) Patent No.: US 9,746,820 B2
(45) Date of Patent: Aug. 29, 2017

(54) IMAGE FORMING APPARATUS THAT ACHIEVES STABLE POSITIONING OF UNIT

(71) Applicant: Kyocera Document Solutions Inc., Osaka (JP)

(72) Inventor: Akinori Matsuno, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/167,973

(22) Filed: May 27, 2016

(65) Prior Publication Data

US 2016/0349696 A1 Dec. 1, 2016

(30) Foreign Application Priority Data

May 27, 2015 (JP) ..... 2015-107008

(51) Int. Cl.
*G03G 21/00* (2006.01)
*G03G 21/16* (2006.01)
*G03G 21/18* (2006.01)

(52) U.S. Cl.
CPC ..... *G03G 21/1619* (2013.01); *G03G 21/1647* (2013.01); *G03G 21/1685* (2013.01); *G03G 21/1853* (2013.01); *G03G 2221/1654* (2013.01); *G03G 2221/1684* (2013.01)

(58) Field of Classification Search
CPC ..... G03G 21/1619; G03G 21/1647; G03G 21/1685; G03G 21/1853; G03G 2221/1654; G03G 2221/1684; G03G 2221/1639; G03G 2221/18
USPC ..... 399/107, 110
See application file for complete search history.

(56) References Cited

U.S. PATENT DOCUMENTS 6,292,638 B1 * 9/2001 Nagamine ..... G03G 15/2035 399/122
2015/0055981 A1 * 2/2015 Fujita ..... G03G 21/168 399/121

FOREIGN PATENT DOCUMENTS

JP 2005-189686 A * 7/2005
JP 2006-226307 A 8/2006

OTHER PUBLICATIONS

Machine translation of JP 2005-189686 A (publication date of Jul. 14, 2005) printed on Mar. 30, 2017.*

* cited by examiner

*Primary Examiner* — Sophia S Chen
(74) *Attorney, Agent, or Firm* — James Judge

(57) ABSTRACT

An image forming apparatus includes an apparatus main body and a unit. The apparatus main body includes a positioning hole extending in a first direction intersecting with a mounting direction of the unit, and a pair of first inner edges extending in the first direction. The unit includes a sheet metal member and a positioning unit formed on a distal end side of the sheet metal member in the mounting direction. The sheet metal member includes a first surface extending along the mounting direction and a second surface located on an opposite side from the first surface. The positioning unit includes a projection piece inserted into the positioning hole, and a protrusion. The protrusion is formed by deforming the sheet metal member such that the second surface of the projection piece is partially perpendicular to the mounting direction and projects to a second direction perpendicular to the first direction.

10 Claims, 19 Drawing Sheets

IMAGE FORMING APPARATUS THAT ACHIEVES STABLE POSITIONING OF UNIT

INCORPORATION BY REFERENCE

This application is based upon, and claims the benefit of priority from, corresponding Japanese Patent Application No. 2015-107008 filed in the Japan Patent Office on May 27, 2015, the entire contents of which are incorporated herein by reference.

BACKGROUND

Unless otherwise indicated herein, the description in this section is not prior art to the claims in this application and is not admitted to be prior art by inclusion in this section.

There has been known a typical image forming apparatus, which forms images on sheets, includes a unit removably attachable to an apparatus main body of the image forming apparatus. As this unit, there has been listed an image forming unit, which forms developer images, and a fixing unit, which performs a fixing process on sheets. The image forming apparatus includes a positioning unit, which positions the respective units on the apparatus main body. There also has been known respective units whose outer walls have been made of a sheet metal member. Thinning the sheet metal member achieves a cost reduction of the units.

The following technique has been proposed. To position a sheet metal member to a sidewall, the sheet metal member has positioning protrusions formed by half blanking. Fitting the positioning protrusions of the sheet metal member to positioning holes, which open at the sidewall, positions the sheet metal member.

SUMMARY

An image forming apparatus according to one aspect of the disclosure forms an image on a sheet. The image forming apparatus includes an apparatus main body and a unit. The unit is mounted to the apparatus main body along a predetermined mounting direction. The apparatus main body has a wall portion. The wall portion is installed in a standing manner opposed to a distal end side of the unit in the mounting direction. The wall portion has a positioning hole and a pair of first inner edges. The positioning hole is open extending in a first direction intersecting with the mounting direction. The first inner edges extend in the first direction and define both side portions of the positioning hole. The unit includes a sheet metal member and a positioning unit. The sheet metal member includes a first surface and a second surface. The first surface extends along the mounting direction. The second surface is located on an opposite side from the first surface. The positioning unit is formed on a distal end side of the sheet metal member in the mounting direction. The positioning unit includes a projection piece and a protrusion. The projection piece is inserted into the positioning hole. The protrusion is formed by deforming the sheet metal member such that the second surface of the projection piece is partially perpendicular to the mounting direction and projects to a second direction. The second direction is perpendicular to the first direction. When the positioning unit is inserted into the positioning hole, the protrusion and the first surface of the sheet metal member are in contact with the respective pair of first inner edges to regulate a position of the unit in the second direction.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
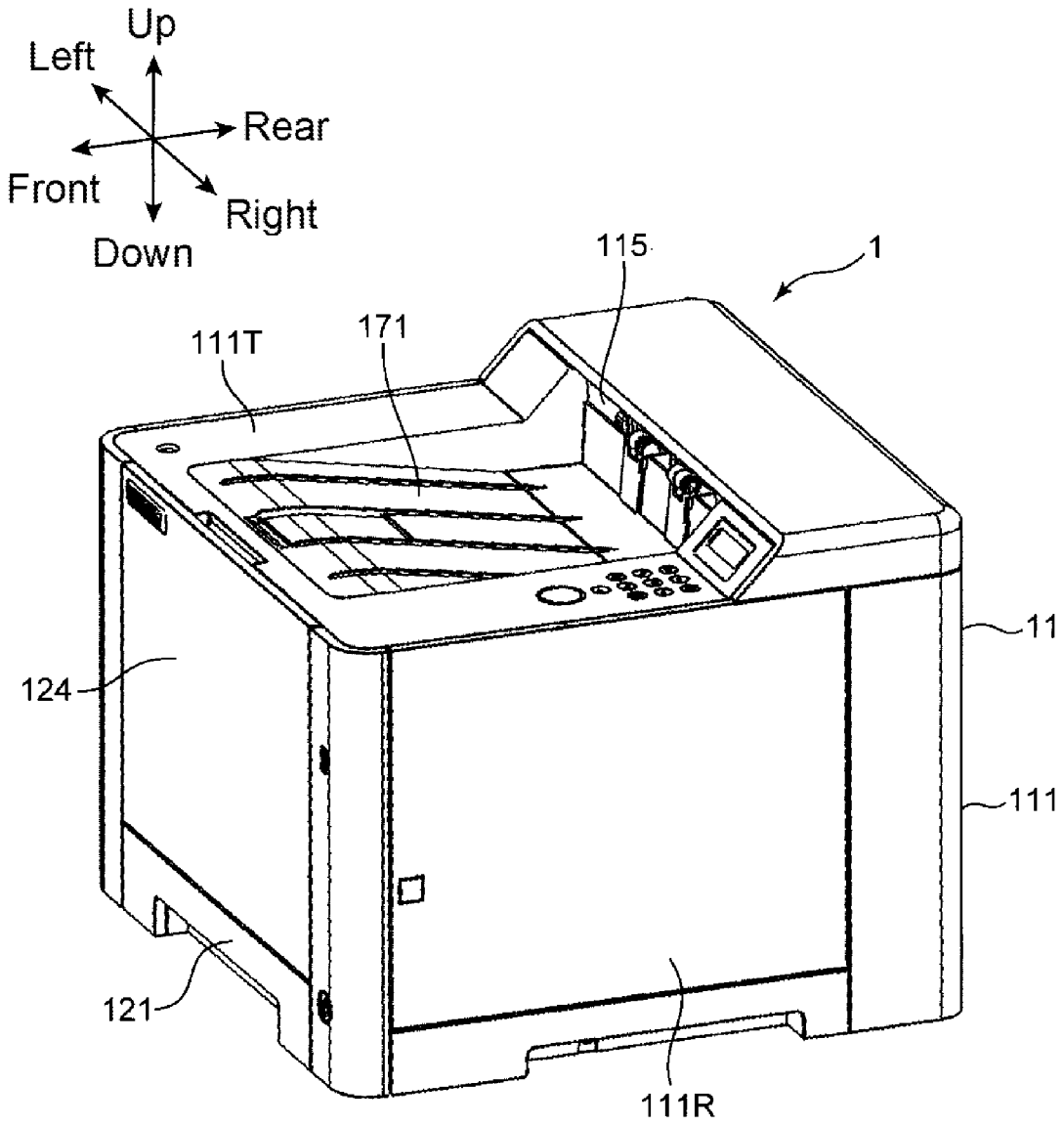
FIG. 1 illustrates an image forming apparatus according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 1 according to an embodiment of the disclosure in detail based on the accompanying drawings. This embodiment exemplifies a tandem type color printer as an exemplary image forming apparatus. The image forming apparatus may be devices such as a copier, a facsimile device, and a multifunctional peripheral of these devices.

Figure 2:
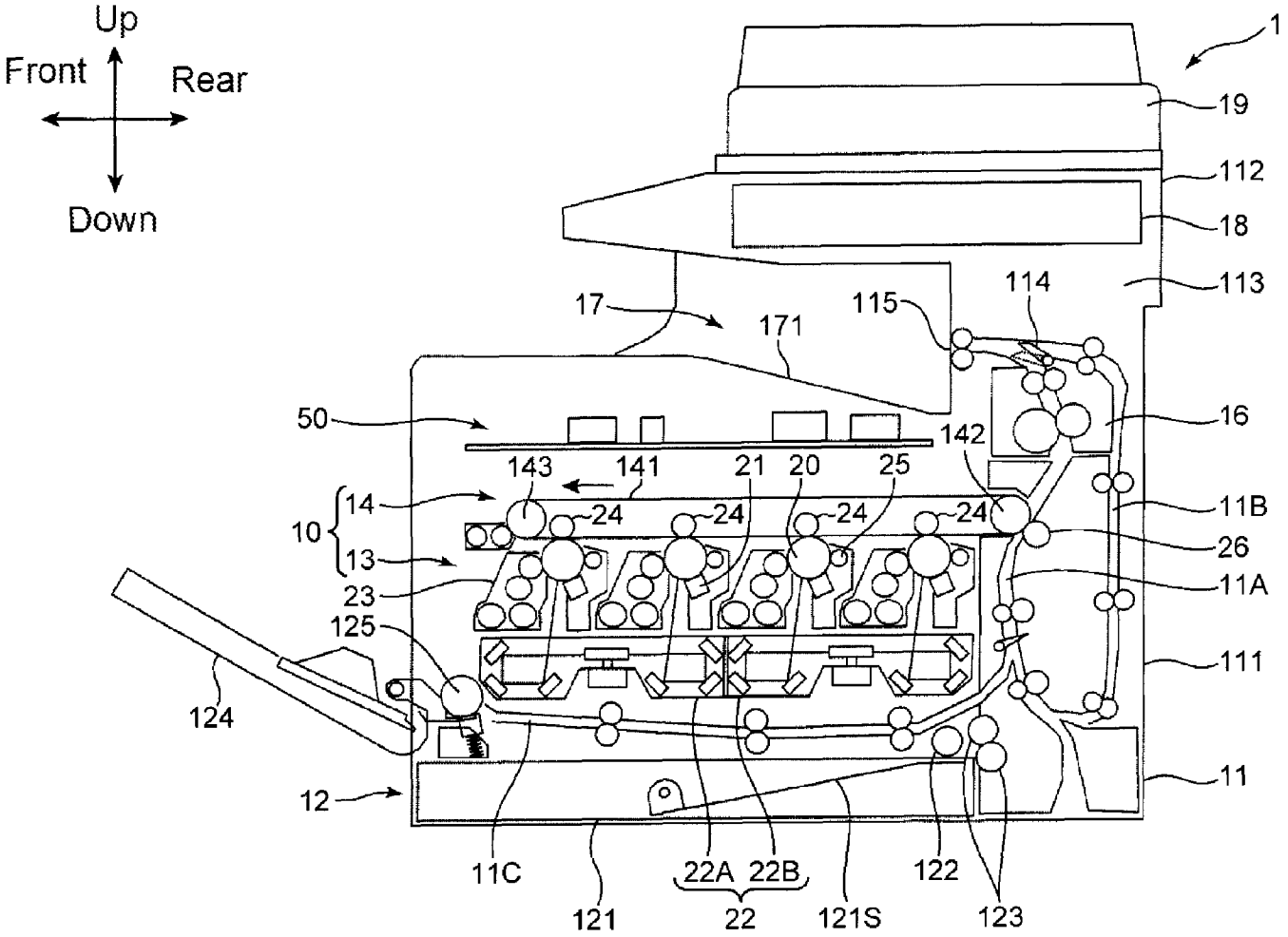
FIG. 2 illustrates an internal structure of the image forming apparatus according to the one embodiment.
Figure 3:
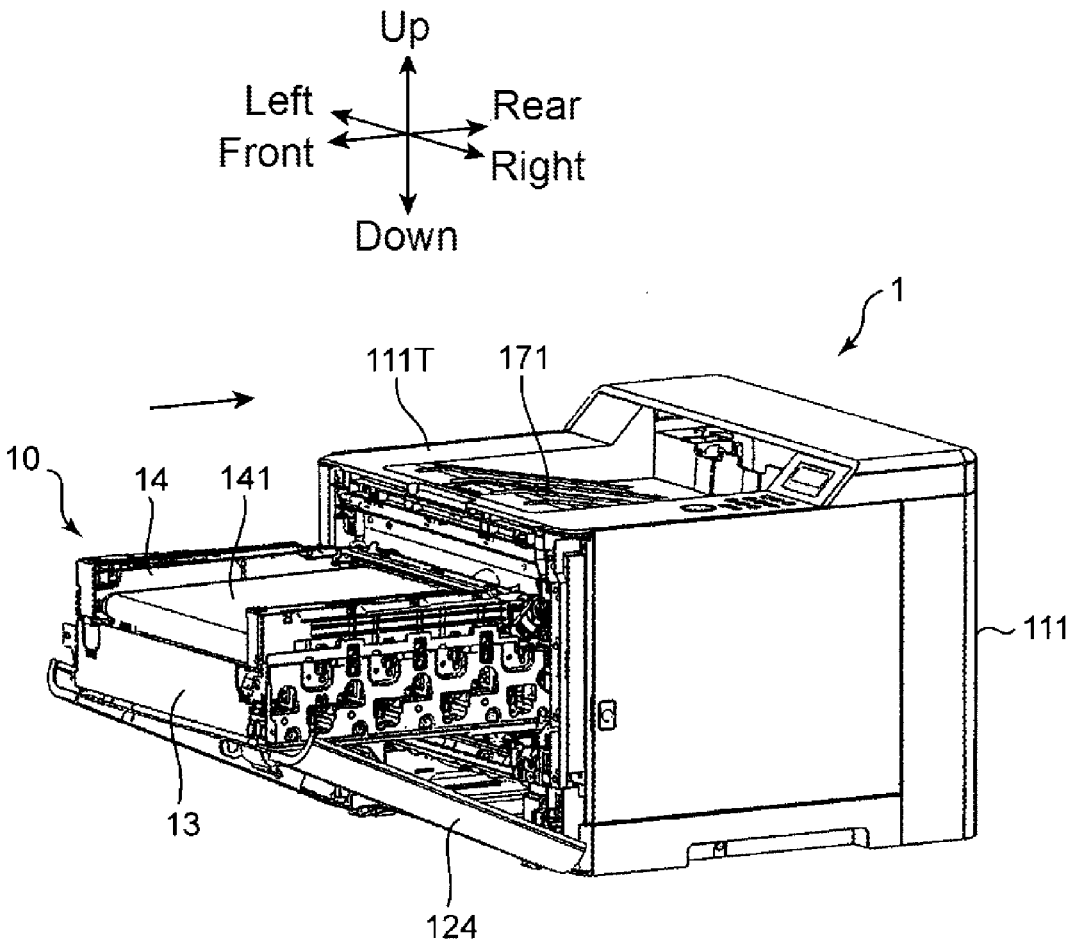
FIG. 3 illustrates a state where an image forming unit is mounted to the image forming apparatus according to the one embodiment.

FIG. 1 illustrates the image forming apparatus 1 according to the embodiment. FIG. 2 illustrates the internal structure of the image forming apparatus 1. FIG. 3 illustrates a state where an image forming unit 10 is mounted to the image forming apparatus 1.

The image forming apparatus 1 includes a box-shaped housing 11. The housing 11 includes a lower chassis 111 (also referred to as an apparatus main body), an upper chassis 112, and a connection chassis 113. In FIGS. 1 and 3, illustrations of the upper chassis 112 and the connection chassis 113 are omitted. The lower chassis 111 defines a lower portion of the housing 11 and has an approximately rectangular parallelepiped shape. The lower chassis 111 includes a top surface cover 111T. The upper chassis 112 is a flat-shaped housing located spaced over the lower chassis 111. The connection chassis 113 connects the lower chassis 111 and the upper chassis 112 in a vertical direction in the respective left end portion and rear end portion. A paper sheet discharge unit 17 is formed between the lower chassis 111 and the upper chassis 112, ahead of the connection chassis 113 (FIG. 2). A sheet with an image formed is discharged to the paper sheet discharge unit 17.

An operation unit is located at a right side portion of the top surface cover 111T of the lower chassis 111 (FIG. 1). The operation unit, which is used for an operation of inputting an output condition or a similar condition to a sheet, includes a power key and various operation keys to input the output condition. The top surface cover 111T is a plate-shaped member constituting a part of the top surface portion of the lower chassis 111 and removably attachable to the lower chassis 111. Removing the top surface cover 111T from the lower chassis 111 exposes the inside of the lower chassis 111. This exposes a high-voltage circuit board 50, which will be described later, outside the lower chassis 111. The top surface cover 111T includes a sheet discharge tray 171. The sheet discharge tray 171 is formed by a part of the top surface cover 111T being sunk below. On the sheet discharge tray 171, a sheet with an image formed is loaded. The sheet discharge tray 171 includes an inclined surface lowering forward, toward an upstream side from a downstream side in a discharge direction of the sheet with an image formed (FIGS. 1 and 2).

Referring to FIG. 2, a main conveyance path 11A, a duplex conveyance path 11B, and a manual paper feed conveyance path 11C extend as conveyance paths, which convey a sheet, inside the lower chassis 111. The main conveyance path 11A passes through a secondary transfer nip portion between an intermediate transfer unit 14 and a secondary transfer roller 26, and a fixing unit 16 from a paper sheet feeder 12 and conveys the sheet up to the upper portion of the lower chassis 111. As illustrated in FIG. 2, a plurality of conveyance roller pairs are located in the main conveyance path 11A.

A switching unit 114 and a sheet discharge exit 115 (FIG. 2) are formed on the upper end portion of the lower chassis 111. The switching unit 114 switches a conveyance direction of the sheet. The sheet having been conveyed in the main conveyance path 11A is discharged to the paper sheet discharge unit 17 from the sheet discharge exit 115. The duplex conveyance path 11B communicates with a downstream-side end portion of the main conveyance path 11A. The duplex conveyance path 11B is a conveyance path that conveys a sheet when an image is formed also on a back surface of the sheet. When the distal end portion of the sheet where an image is formed on the front surface is exposed in the paper sheet discharge unit 17 from the sheet discharge exit 115, the switching unit 114 rotates to switch the conveyance path of the sheet. After that, a conveyance roller pair (not illustrated) is reversely rotated to carry the sheet in the duplex conveyance path 11B. The sheet conveyed in the duplex conveyance path 11B is carried again in the main conveyance path 11A in the upstream side with respect to the secondary transfer nip portion. This forms an image on the back surface of the sheet. The manual paper feed conveyance path 11C is a conveyance path that carries a sheet conveyed from a manual bypass tray 124, which will be described later, into the main conveyance path 11A. The manual paper feed conveyance path 11C extends in the horizontal direction over a sheet feed cassette 121.

The image forming apparatus 1 includes the paper sheet feeder 12, an image forming portion 13, the intermediate transfer unit 14, the secondary transfer roller 26 (also referred to as a transfer unit), the fixing unit 16 (also referred to as a unit), a reading unit 18, an automatic document feeder 19, and the high-voltage circuit board 50.

The paper sheet feeder 12 is located in the lower chassis 111 and feeds a sheet. The paper sheet feeder 12 includes the sheet feed cassette 121, a pickup roller 122, a feed roller pair 123, the manual bypass tray 124, and a manual paper feed roller 125.

The sheet feed cassette 121 is insertably/removably mounted in a lower position of the lower chassis 111 from a front and retains a sheet bundle formed by a plurality of stacked sheets. The sheet feed cassette 121 includes a lift plate 121S internally. The rear end side of the lift plate 121S is moved upward by an elevating mechanism (not illustrated). This causes the sheets stacked on the lift plate 121S to contact with the pickup roller 122. The pickup roller 122 feeds the sheets retained in the sheet feed cassette 121. The feed roller pair 123 sends out the sheets fed by the pickup roller 122 to the main conveyance path 11A by separating the sheets one by one. The manual bypass tray 124 is a tray to place a sheet, which is fed manually. As illustrated in FIG. 2, the manual bypass tray 124 is opened from the front side surface of the lower chassis 111 when sheets are fed manually. The manual paper feed roller 125 feeds the sheets placed in the manual bypass tray 124 to the manual paper feed conveyance path 11C.

The image forming portion 13 forms a toner image (also referred to as a developer image) for transferring to a sheet and includes a plurality of units forming different color toner images. As this unit, this embodiment includes a magenta unit using a magenta (M) color developer, a cyan unit using a cyan (C) color developer, a yellow unit using a yellow (Y) color developer, and a black unit using a black (BK) color developer, which are sequentially located toward the downstream side from the upstream side (from the front side to the rear side in FIG. 2), in the rotation direction of the intermediate transfer belt 141, which will be described later. Each of the units include a photoreceptor drum 20, a charging apparatus 21 located in the peripheral area of the photoreceptor drum 20, a developing device 23, and a cleaning apparatus 25. An exposure apparatus 22 for exposure of the photoreceptor drum 20 of the respective units is located under the image forming portion 13. The exposure apparatus 22 includes a first exposure unit 22A and a second exposure unit 22B. The first exposure unit 22A irradiates a laser beam corresponding to image information on circumference surfaces of the photoreceptor drums 20 of the magenta unit and the cyan unit. The second exposure unit 22B irradiates a laser beam that corresponding to image information on the circumference surfaces of the photoreceptor drums 20 of the yellow unit and the black unit.

The photoreceptor drum 20 is rotatably driven around its shaft, and an electrostatic latent image and a toner image are formed on the circumference surface of the photoreceptor drum 20. As the photoreceptor drum 20, a photoreceptor drum using amorphous silicon (a-Si)-based material can be employed. As illustrated in FIG. 2, the photoreceptor drum 20 is located corresponding to the unit of the respective colors. The charging apparatus 21 uniformly charges the surface of the photoreceptor drum 20. As the charging apparatus 21, a charging apparatus by a contact electrification system can be employed. The charging apparatus includes a charging roller and a charge cleaning brush for removing toner attached to the charging roller. The cleaning apparatus 25 cleans the circumference surface of the photoreceptor drum 20 after transfer of a toner image.

The developing device 23 supplies toner on the circumference surface of the photoreceptor drum 20 for development of the electrostatic latent image formed on the photoreceptor drum 20. The developing device 23 uses a two-component developer made from toner and a carrier, and includes two agitation rollers, a magnetic roller, and a developing roller. The agitation roller performs circulatory conveyance while stirring the two-component developer and thus charges the toner. The circumference surface of the magnetic roller carries the two-component developer layer, and the circumference surface of the developing roller carries a toner layer formed by hand-over of the toner due to an electric potential difference between the magnetic roller and the developing roller. The toner on the developing roller is supplied to the circumference surface of the photoreceptor drum 20, and thus the electrostatic latent image is developed.

The intermediate transfer unit 14 is located over the image forming portion 13. Referring to FIG. 2, the intermediate transfer unit 14 includes an intermediate transfer belt 141, a drive roller 142, a driven roller 143, and a plurality of primary transfer rollers 24.

The intermediate transfer belt 141 is an endless belt-shaped rotator and is suspended across the drive roller 142 and the driven roller 143 such that its circumference surface side is brought into contact with the circumference surface of the respective photoreceptor drums 20. The intermediate transfer belt 141 is circularly driven in one direction (an arrow direction in FIG. 2), and carries the toner image transferred from the photoreceptor drum 20 on its surface. The intermediate transfer belt 141 is a conductive soft belt with a laminated structure made of a base layer, an elastic layer, and a coat layer.

The drive roller 142 stretches the intermediate transfer belt 141 in the rear end side of the intermediate transfer unit 14 and causes the intermediate transfer belt 141 to be circularly driven. The driven roller 143 stretches the intermediate transfer belt 141 in the front end side of the intermediate transfer unit 14. The driven roller 143 gives tension to the intermediate transfer belt 141.

The primary transfer roller 24 primarily transfers the toner image on the photoreceptor drum 20 on the intermediate transfer belt 141. As illustrated in FIG. 2, the primary transfer roller 24 is located facing to the photoreceptor drum 20 of each color. This forms primary transfer nip portions of the respective colors between the respective photoreceptor drums 20 and primary transfer rollers 24 sandwiching the intermediate transfer belt 141.

In this embodiment, the image forming portion 13 and the intermediate transfer unit 14 are integrated as the image forming unit 10 (also referred to as the unit) and are removably attachable to the lower chassis 111. Especially, as illustrated in FIG. 3, the image forming unit 10 is mounted to the lower chassis 111 along a rear direction (a mounting direction, the arrow in FIG. 3).

The secondary transfer roller 26 (also referred to as a transfer unit) is located facing to the drive roller 142 while sandwiching the intermediate transfer belt 141. The secondary transfer roller 26 forms the secondary transfer nip portion by being pressurized with the circumference surface of the intermediate transfer belt 141. The secondary transfer roller 26 transfers the toner image from the intermediate transfer belt 141 to the sheet supplied from the paper sheet feeder 12.

Figure 4:
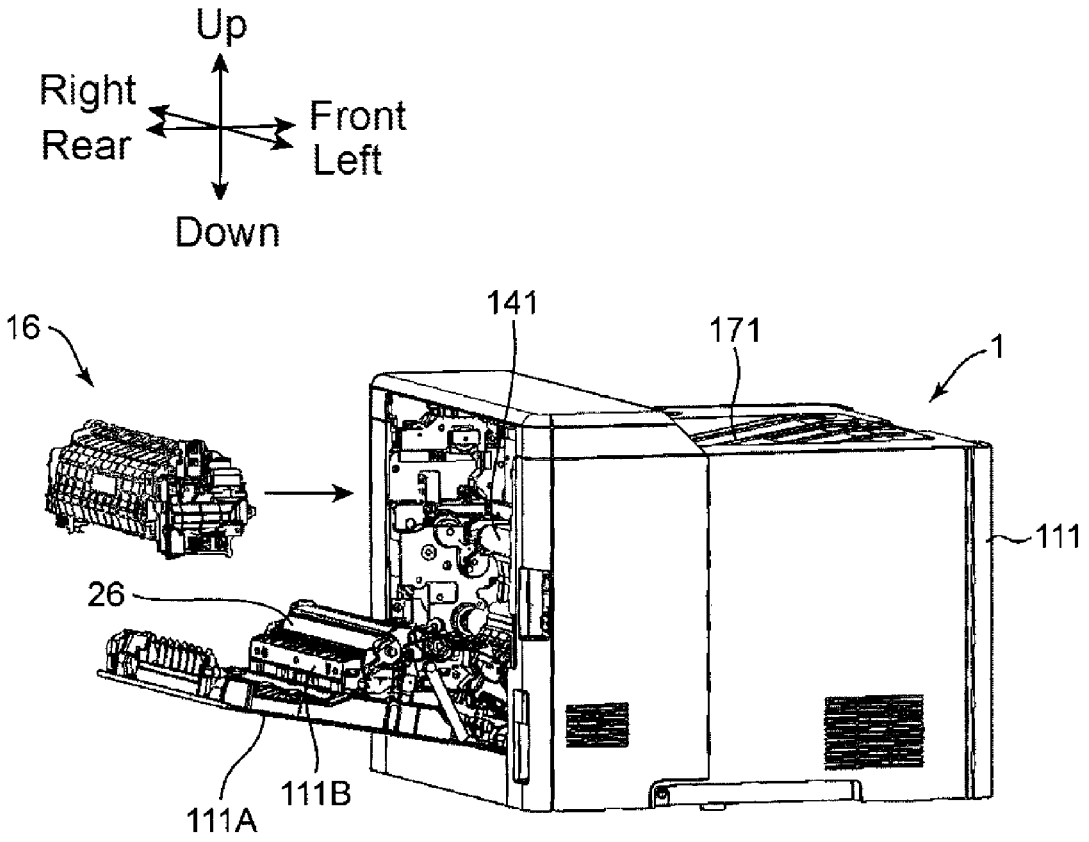
FIG. 4 illustrates a state where a fixing unit is mounted to the image forming apparatus according to the one embodiment.

The fixing unit 16 includes a fixing roller with an internal heating source and a pressure roller that forms a fixing nip portion being located facing the fixing roller. The sheet supplied to the fixing unit 16 is heated and pressured by passing the fixing nip portion. This fixes the toner image, which has been transferred onto the sheet in the secondary transfer nip portion, to the sheet. FIG. 4 illustrates a state where the fixing unit 16 is mounted to the lower chassis 111 of the image forming apparatus 1 according to the embodiment. The fixing unit 16 is removably attachable to the lower chassis 111. Especially, as illustrated in FIG. 4, the fixing unit 16 is mounted to the lower chassis 111 along a front direction (the mounting direction, the arrow in FIG. 4). In this respect, an opening/closing cover 111A, which defines a rear side surface of the lower chassis 111, is preliminarily opened. In association with the opening of the opening/closing cover 111A, a duplex conveyance path 10B (FIG. 2) is exposed outside the lower chassis 111. Further, opening a conveyance unit 111B, which is openable integrally with the opening/closing cover 111A, exposes a part of a main conveyance path 10A outside the lower chassis 111. Consequently, a sheet stuck at the main conveyance path 10A or the duplex conveyance path 10B is removable.

The reading unit 18 is located inside the upper chassis 112. The reading unit 18 reads an image of a document sheet, which is sent out by the automatic document feeder 19, or a document sheet placed on a contact glass (not illustrated). The automatic document feeder 19 feeds the document sheet to a reading position formed on the contact glass.

Figure 5:
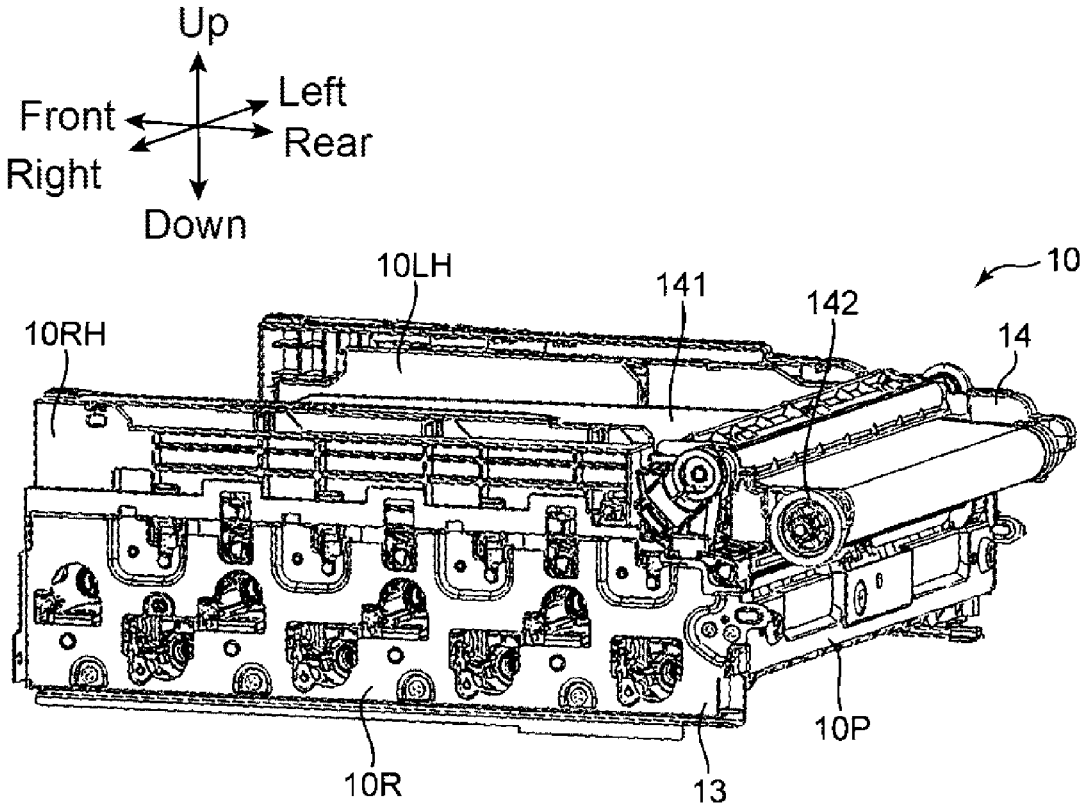
FIG. 5 illustrates the image forming unit according to the one embodiment.
Figure 6:
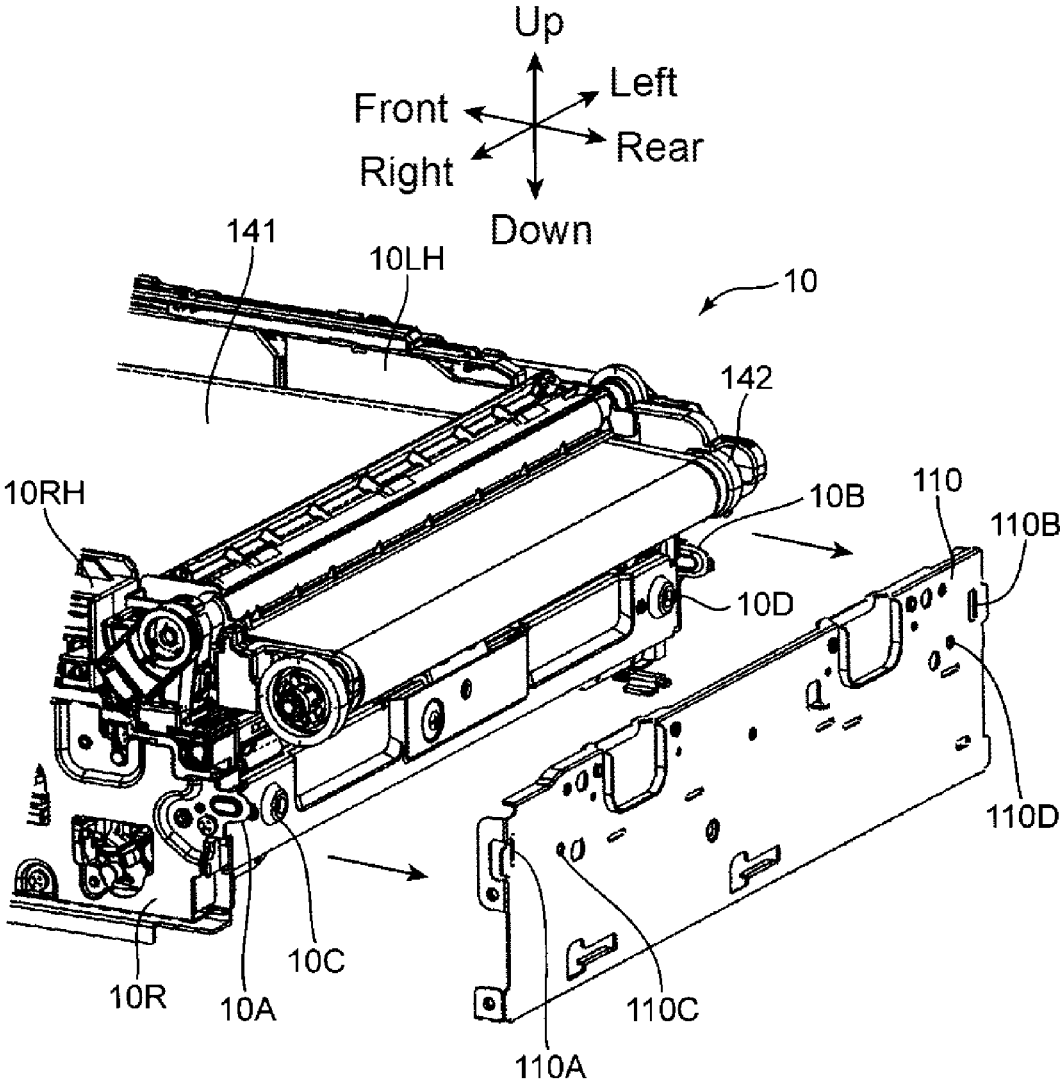
FIG. 6 illustrates the image forming unit and a wall portion according to the one embodiment.
Figure 7A:
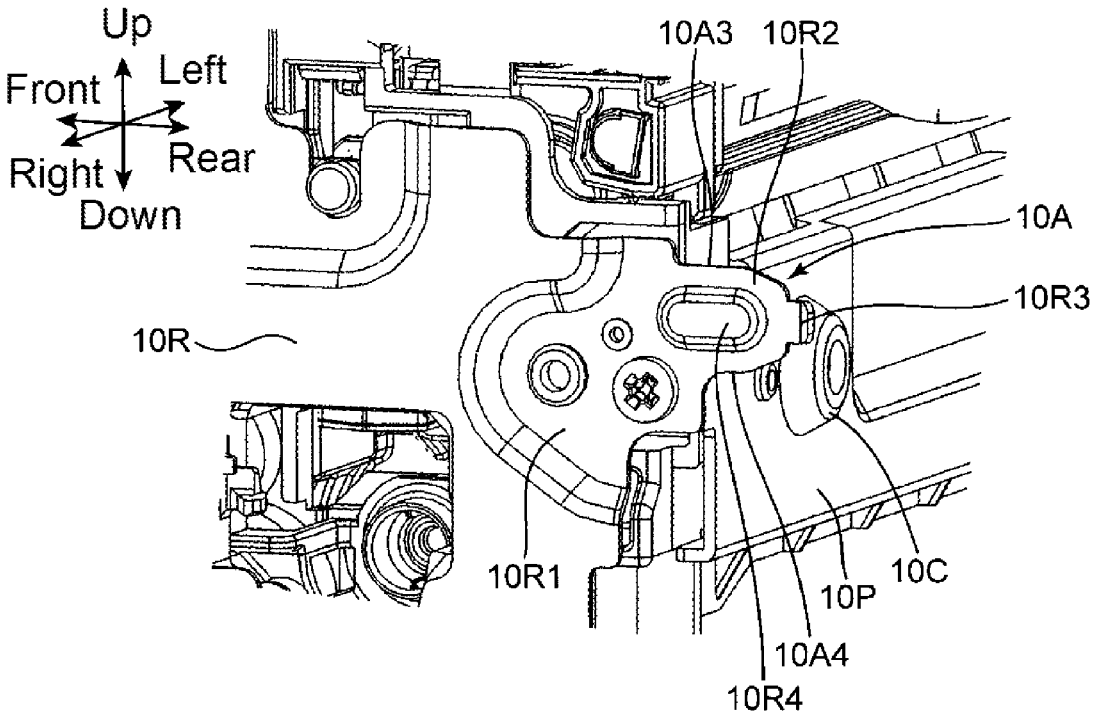
FIGS. 7A to 7C illustrate a part of the enlarged image forming unit according to the one embodiment.
Figure 7B:
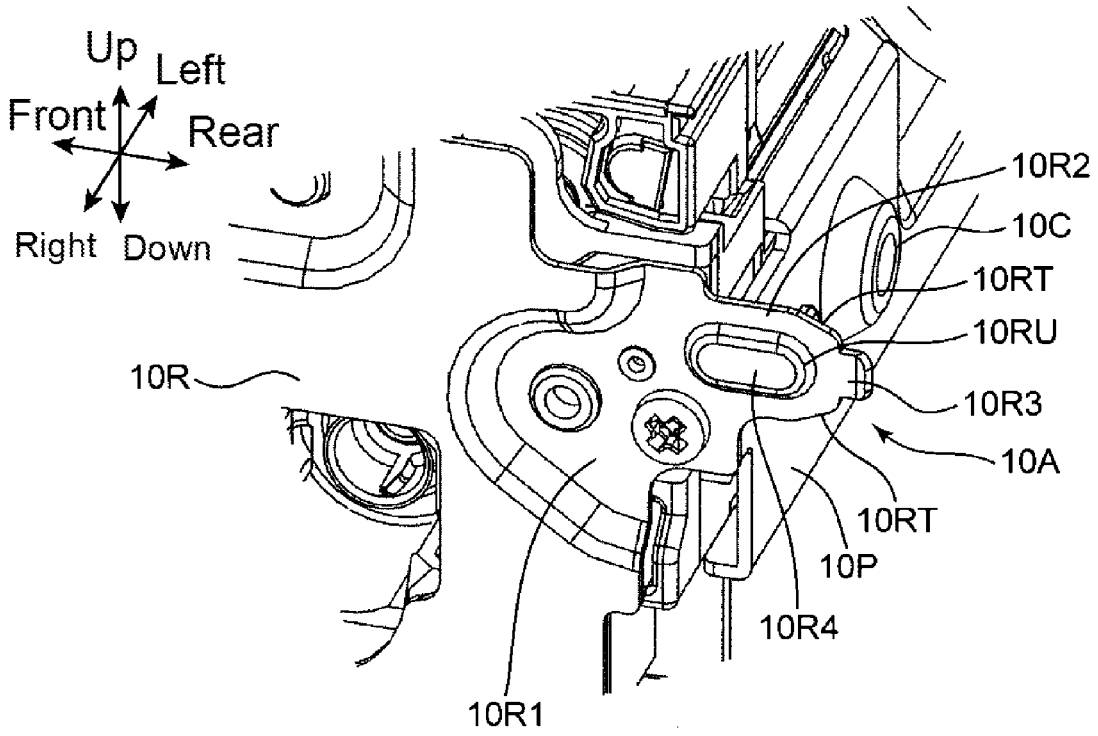
Figure 7C:
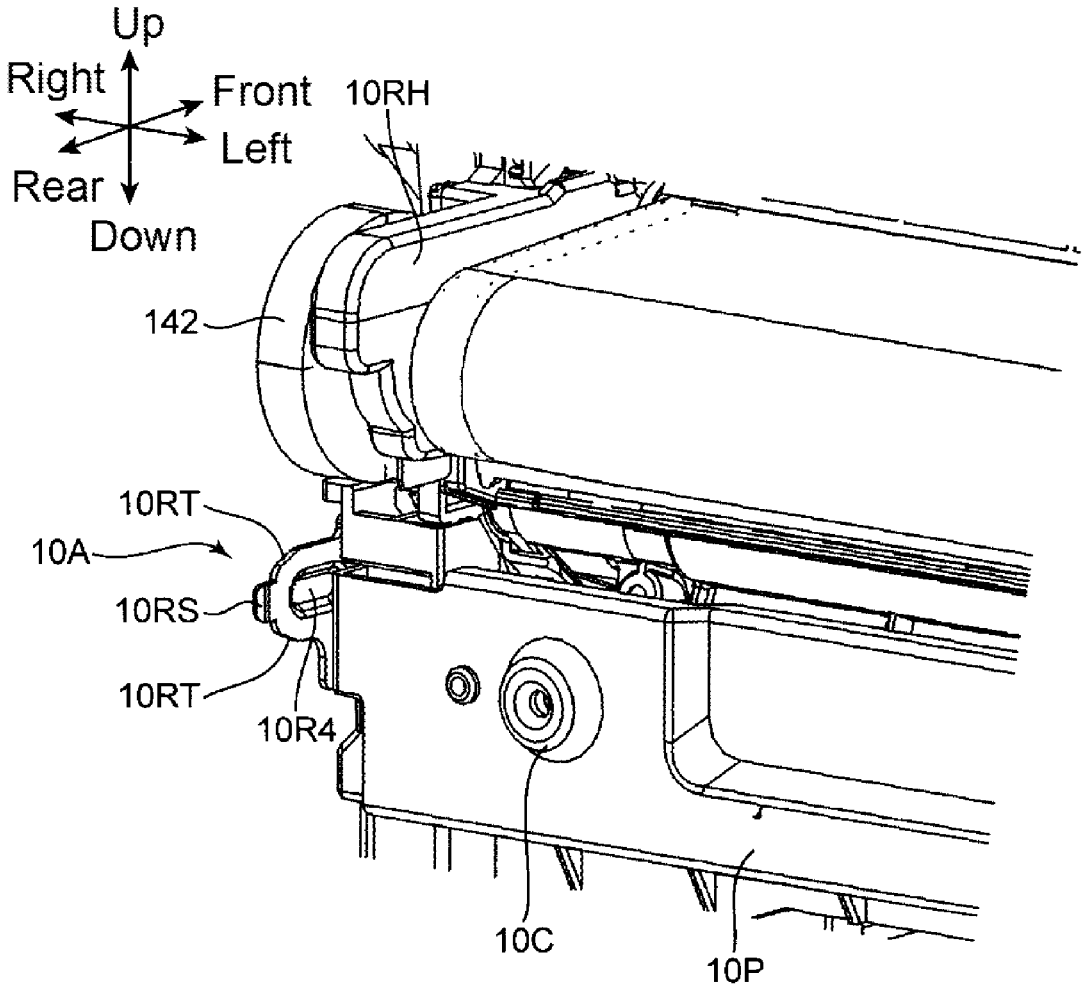

FIG. 5 illustrates the image forming unit 10 according to the embodiment. FIG. 6 illustrates the image forming unit 10 and a first plate 110 according to the embodiment. FIGS. 7A, 7B, and 7C illustrate a part of the enlarged image forming unit 10.

The image forming unit 10 is a unit that has a predetermined height in the vertical direction and has an approximately box shape extending in front-rear and lateral directions. The intermediate transfer unit 14 is located on an upper side portion of the image forming unit 10. The image forming portion 13 is located on the lower side portion of the image forming unit 10. The image forming unit 10 includes a right unit wall portion 10RH, a left unit wall portion 10LH, and a unit front wall 10P. The right unit wall portion 10RH and the left unit wall portion 10LH are wall portions located extending in the front-rear direction at both the end portions of the image forming unit 10 in the lateral direction. The right unit wall portion 10RH and a left unit wall portion 10LH function as a housing to support respective members of the image forming unit 10. Further, the right unit wall portion 10RH includes a right plate 10R (also referred to as a sheet metal member). The right plate 10R is a plate made of the sheet metal member tightened to the lower portion of the right unit wall portion 10RH. The right plate 10R rotatably supports the plurality of photoreceptor drums 20 in the image forming portion 13. In view of this, the right plate 10R includes bearing portions (not illustrated) through which rotation shafts of the photoreceptor drums 20 are inserted. Although not appeared in FIG. 5, a left plate, which is made of a sheet metal member similar to the right plate 10R, is tightened also to the left unit wall portion 10LH. Since the right plate 10R and the left plate are made of a thin sheet-shaped metal plate, the right plate 10R and the left plate have two side surfaces each extending along the mounting directions. This embodiment defines a side surface located inside in the lateral direction as a first surface among these side surfaces. This embodiment defines a side surface located opposite side from the first surface and outside in the lateral direction as a second surface.

The unit front wall 10P is a wall portion extending in the lateral direction. The unit front wall 10P connects the right unit wall portion 10RH and the left unit wall portion 10LH on a rear end side of the image forming unit 10. The unit front wall 10P is located on a distal end side of the image forming unit 10 in the mounting direction (the arrow direction in FIG. 6) with respect to the lower chassis 111.

The image forming unit 10 further includes a first positioning unit 10A (also referred to as a positioning unit), a second positioning unit 10B (also referred to as a positioning unit), a right securing portion 10C, and a left securing portion 10D. The first positioning unit 10A is integrally formed with the right plate 10R on the distal end side of the right plate 10R in the mounting direction. The second positioning unit 10B is integrally formed with the left plate on the distal end side of the left plate in the mounting direction. As illustrated in FIG. 6, the first positioning unit 10A and the second positioning unit 10B are located projecting to the first plate 110, which will be described later, at the lower portion of the drive roller 142 of the intermediate transfer unit 14. The right securing portion 10C is a circular plate-shaped protrusion projecting to the first plate 110 at a right end portion of the unit front wall 10P (FIG. 5). Similarly, the left securing portion 10D is a circular plate-shaped protrusion projecting to the first plate 110 at a left end portion of the unit front wall 10P. Both the right securing portion 10C and the left securing portion 10D include holes to both of which screws can be tightened.

With reference to FIG. 6, the lower chassis 111 includes the first plate 110 (also referred to as a wall portion). The first plate 110 is a wall portion installed in a standing manner opposed to the distal end side (also referred to as the unit front wall 10P) of the image forming unit 10 in the mounting direction inside the lower chassis 111. In this embodiment, the first plate 110 is made of the sheet metal member. The first plate 110 includes a first hole 110A (also referred to as a positioning hole), a second hole 110B (also referred to as a positioning hole), a first screw hole 110C, and a second screw hole 110D. The first hole 110A is located on a right end portion of the first plate 110. The first hole 110A is an elongated hole-shaped opening that opens extending in the vertical direction (also referred to as a first direction intersecting with the mounting direction of the image forming unit 10). Similarly, the second hole 110B is located on the left end portion of the first plate 110. The second hole 110B is an elongated hole-shaped opening that opens extending in the vertical direction. The first screw hole 110C is a hole that opens on the first plate 110 on the left side with respect to the first hole 110A. Similarly, the second screw hole 110D is a hole that opens on the first plate 110 on the right side with respect to the second hole 110B. When the image forming unit 10 is inserted to the lower chassis 111, soon the first positioning unit 10A is inserted into the first hole 110A, and the second positioning unit 10B is inserted into the second hole 110B. This regulates the position of the image forming unit 10 in the vertical direction and the lateral direction (also referred to as a second direction, a direction perpendicular to the mounting direction of the image forming unit 10 and the first direction). Further, the right securing portion 10C and the left securing portion 10D abut on a surface on the front side of the first plate 110. In this respect, the first screw hole 110C and the second screw hole 110D communicate with holes on the right securing portion 10C and the left securing portion 10D, respectively. An operator opens the opening/closing cover 111A and tightens the image forming unit 10 and the first plate 110 with the screws inserted into the first screw hole 110C and the second screw hole 110D from rearward. Consequently, a position of the image forming unit 10 in the front-rear direction (also referred to as the mounting direction) is regulated.

With reference to FIG. 7A, the right plate 10R includes a concave portion 10R1 and a projection piece 10R2. The concave portion 10R1 is a region formed by partially depressing the rear end portion of the right plate 10R to the left. In this embodiment, the concave portion 10R1 is formed by drawing process. The projection piece 10R2 is formed by projecting a rear end portion of the concave portion 10R1 rearward. In this embodiment, the first positioning unit 10A is located at this projection piece 10R2. That is, the insertion of the image forming unit 10 to the lower chassis 111 inserts the projection piece 10R2 into the first hole 110A (FIG. 6). The projection piece 10R2 includes a projection piece upper end portion 10A3 (also referred to as an outer edge portion), a projection piece lower end portion 10A4 (also referred to as an outer edge portion), and a pair of inclined guide portions 10RT (also referred to as an inclined portion) (FIG. 7B). The projection piece upper end portion 10A3 and the projection piece lower end portion 10A4 are located spaced from one another in the vertical direction. The respective projection piece upper end portion 10A3 and projection piece lower end portion 10A4 are outer edge portions of the projection piece 10R2, which extends in the front-rear direction. The inclined guide portions 10RT are located at the distal end portions of the projection piece upper end portion 10A3 and the projection piece lower end portion 10A4 in the mounting direction. The inclined guide portions 10RT are inclined such that the projection piece 10R2 becomes a tapered along the mounting direction. The projection piece 10R2 further includes a distal end piece 10R3 (also referred to as a distal end protrusion) and a drawn portion 10R4 (also referred to as a protrusion).

The distal end piece 10R3 is located at the distal end portion of the projection piece 10R2 in the mounting direction. The distal end piece 10R3 projects rearward providing a width smaller than an interval between the projection piece upper end portion 10A3 and the projection piece lower end portion 10A4. A bending process is performed on the distal end piece 10R3. The distal end portion of the distal end piece 10R3 curves such that a left-side surface (also referred to as a first surface) of the right plate 10R warps toward a right-side surface (also referred to as a second surface) side. Consequently, an inclined distal end surface 10RS (see FIGS. 7C and 9) is formed at the distal end piece 10R3.

The drawn portion 10R4 is formed by deforming the right plate 10R such that the right-side surface of the projection piece 10R2 has an approximately elliptical shape partially and projects rightward. In this embodiment, the well-known drawing process is performed on the projection piece 10R2 to form the drawn portion 10R4. Therefore, the opposite side of the drawn portion 10R4, namely, the left-side surface of the projection piece 10R2 is partially concaved (see FIG. 9).

The drawn portion 10R4 includes an inclined drawn portion 10RU (FIG. 7B). The inclined drawn portion 10RU is formed of an inclined portion where a distal end side portion of the drawn portion 10R4 in the mounting direction is inclined in a tapered manner toward the right side surface of the projection piece 10R2.

Figure 8A:
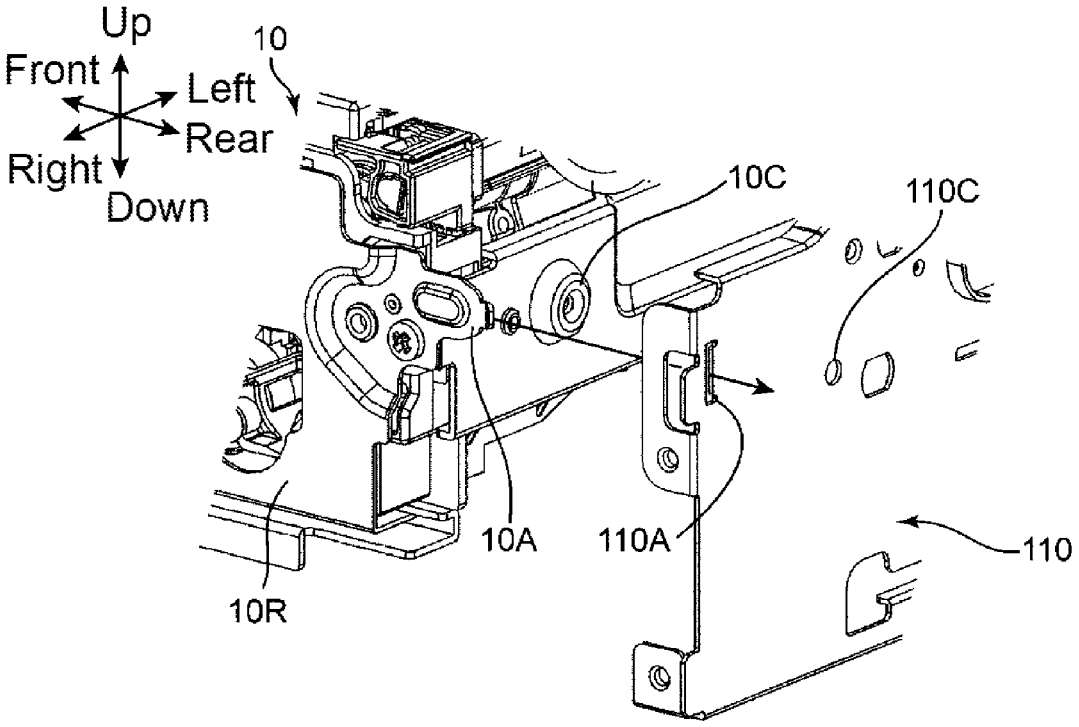
FIGS. 8A and 8B illustrate a state where the image forming unit according to the one embodiment is mounted to the wall portion.
Figure 8B:
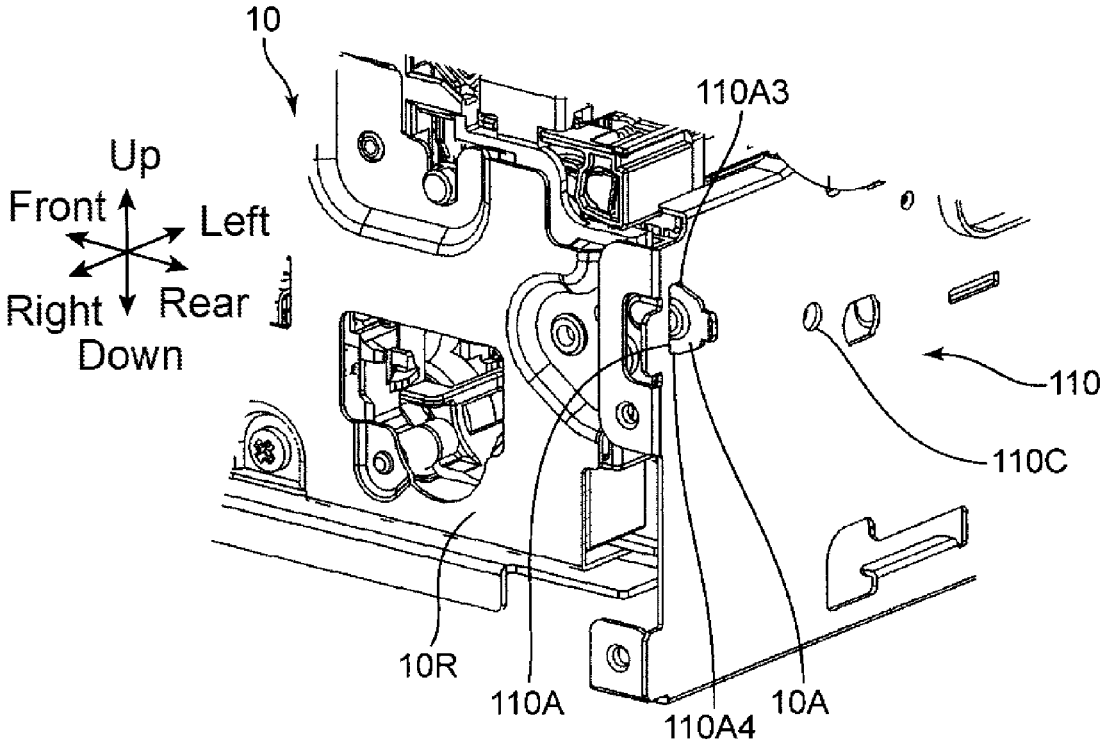
Figure 9:
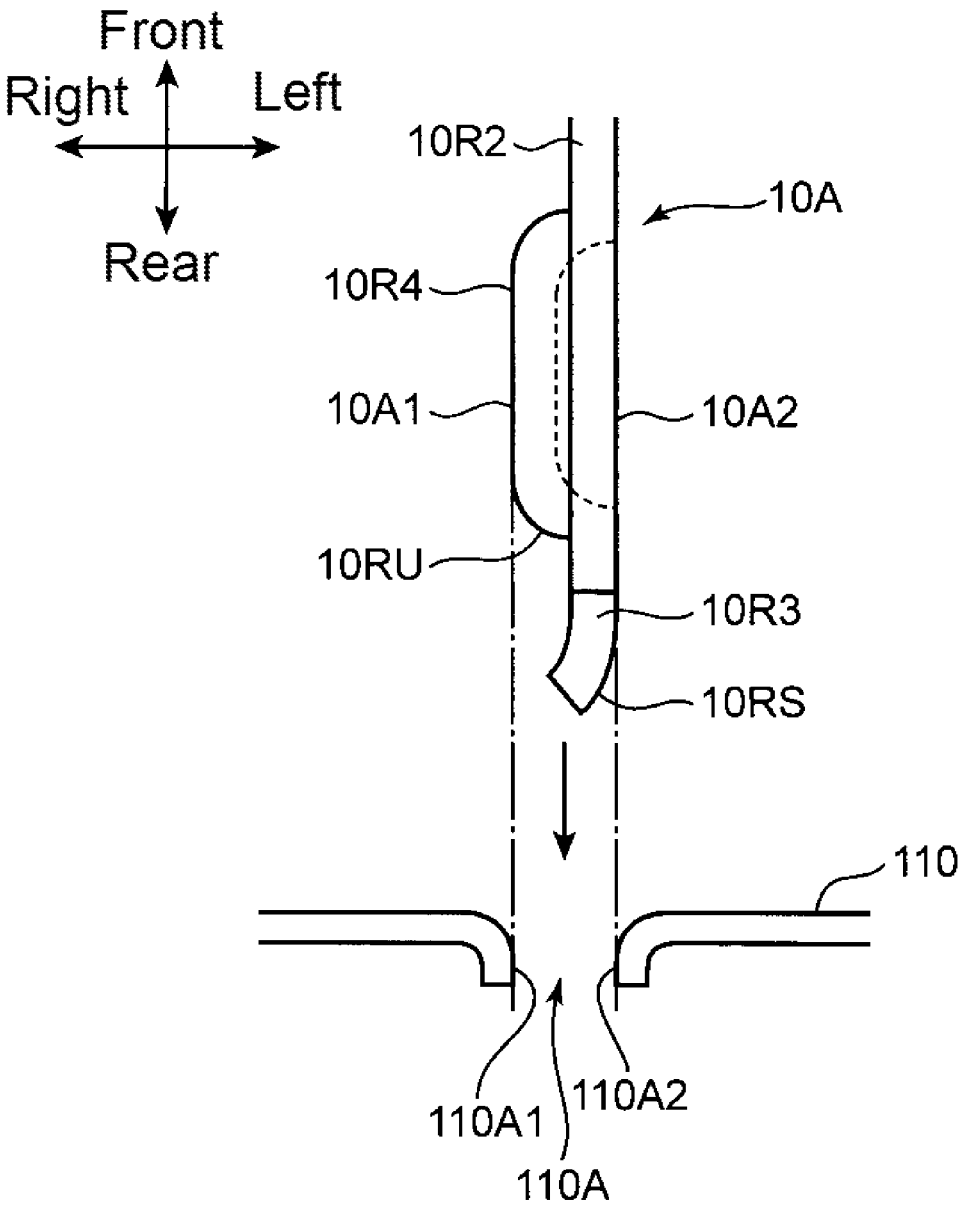
FIG. 9 illustrates a state where a positioning unit of the image forming unit according to the one embodiment enters into a positioning hole on the wall portion.

FIG. 8A illustrates a state where the image forming unit 10 according to the embodiment is mounted to the first plate 110. FIG. 8B illustrates a state where the image forming unit 10 is mounted to the first plate 110. FIG. 9 illustrates a state where the first positioning unit 10A of the image forming unit 10 enters into the first hole 110A of the first plate 110.

With reference to FIGS. 8B and 9, the first plate 110 includes a first side edge 110A1 (also referred to as a first inner edge), a second side edge 110A2 (also referred to as a first inner edge), an upper end edge 110A3 (also referred to as a second inner edge), and a lower end edge 110A4 (also referred to as a second inner edge). The first hole 110A forms an elongated, approximately rectangular shape extending in the vertical direction. The first side edge 110A1 and the second side edge 110A2 are a pair of inner edges that extend in the vertical direction and define both the right and left side portions of the first hole 110A. The upper end edge 110A3 and the lower end edge 110A4 are a pair of inner edges that connect the first side edge 110A1 and the second side edge 110A2, respectively and define both the end portions of the first hole 110A in the vertical direction. As illustrated in FIG. 9, in this embodiment, the bending process is performed on the respective inner edges, which define the first hole 110A, to the distal end side of the image forming unit 10 in the mounting direction. Especially, in this embodiment, the well-known barring process or drawing process is performed on the peripheral edge of the first hole 110A.

As indicated by the arrow in FIG. 9, the insertion of the first positioning unit 10A into the first hole 110A causes a right end surface (also referred to as a first securing surface 10A1 in FIG. 9) of the drawn portion 10R4 and a left-side surface (also referred to as a second securing surface 10A2 in FIG. 9) of the projection piece 10R2 to abut on the first side edge 110A1 and the second side edge 110A2, respectively. This regulates the position of the first positioning unit 10A (also referred to as the image forming unit 10) in the lateral direction. Further, when the projection piece upper end portion 10A3 and the projection piece lower end portion 10A4 of the projection piece 10R2 (FIG. 7A) abut on the upper end edge 110A3 and the lower end edge 110A4 of the first hole 110A (FIG. 8B), the position of the first positioning unit 10A (also referred to as the image forming unit 10) in the vertical direction is regulated. The similar positioning is achieved also in the second positioning unit 10B and the second hole 110B.

Thus, in this embodiment, the drawn portion 10R4 and the left-side surface of the projection piece 10R2 regulate the position of the first positioning unit 10A of the image forming unit 10. Accordingly, compared with the case where the position of the first positioning unit 10A is regulated with the right-side surface and the left-side surface of the thin plate-shaped right plate 10R without providing the drawn portion 10R4, this configuration enhances a rigidity of the first positioning unit 10A and stably maintains the position of the first positioning unit 10A. Consequently, the position of the image forming unit 10 with respect to the lower chassis 111 is stably regulated. When the projection piece upper end portion 10A3 and the projection piece lower end portion 10A4 are in contact with the upper end edge 110A3 and the lower end edge 110A4, the position of the first positioning unit 10A is further stably maintained. Accordingly, without providing a complicated positioning mechanism, the positioning of the image forming unit 10 can be achieved with the low-price sheet metal member. Further, in this embodiment, the right plate 10R and the left plate (not illustrated), which rotatably support the photoreceptor drum 20, includes the first positioning unit 10A and the second positioning unit 10B. Accordingly, compared with the case where a plurality of positioning parts are interposed between the photoreceptor drum 20 and the first plate 110, this configuration ensures accurately regulating the position of the photoreceptor drum 20 in the lower chassis 111.

In this embodiment, as illustrated in FIG. 9, the inclined distal end surface 10RS is formed so as to be inwardly curved from the second securing surface 10A2 of the first positioning unit 10A. Therefore, even when the position of the first positioning unit 10A in the lateral direction varies at a phase of inserting the image forming unit 10, by bringing the inclined distal end surface 10RS in contact with the second side edge 110A2 to guide the inclined distal end surface 10RS achieves smooth entrance of the first positioning unit 10A to the first hole 110A.

Further, at the first positioning unit 10A, the inclined drawn portion 10RU is formed so as to be inwardly curved from the first securing surface 10A1 of the first positioning unit 10A. Therefore, even when the position of the first positioning unit 10A in the lateral direction varies at the phase of inserting the image forming unit 10, by bringing the inclined drawn portion 10RU in contact with the first side edge 110A1 to guide the inclined drawn portion 10RU achieves smooth entrance of the first positioning unit 10A to the first hole 110A.

Similarly, a simple bending process is performed on the first side edge 110A1, the second side edge 110A2, the upper end edge 110A3, and the lower end edge 110A4 of the first hole 110A to guide the entrance of the first positioning unit 10A to the first hole 110A. Another embodiment may employ an aspect where a bending process is performed on any of the first side edge 110A1, the second side edge 110A2, the upper end edge 110A3, and the lower end edge 110A4.

Figure 10:
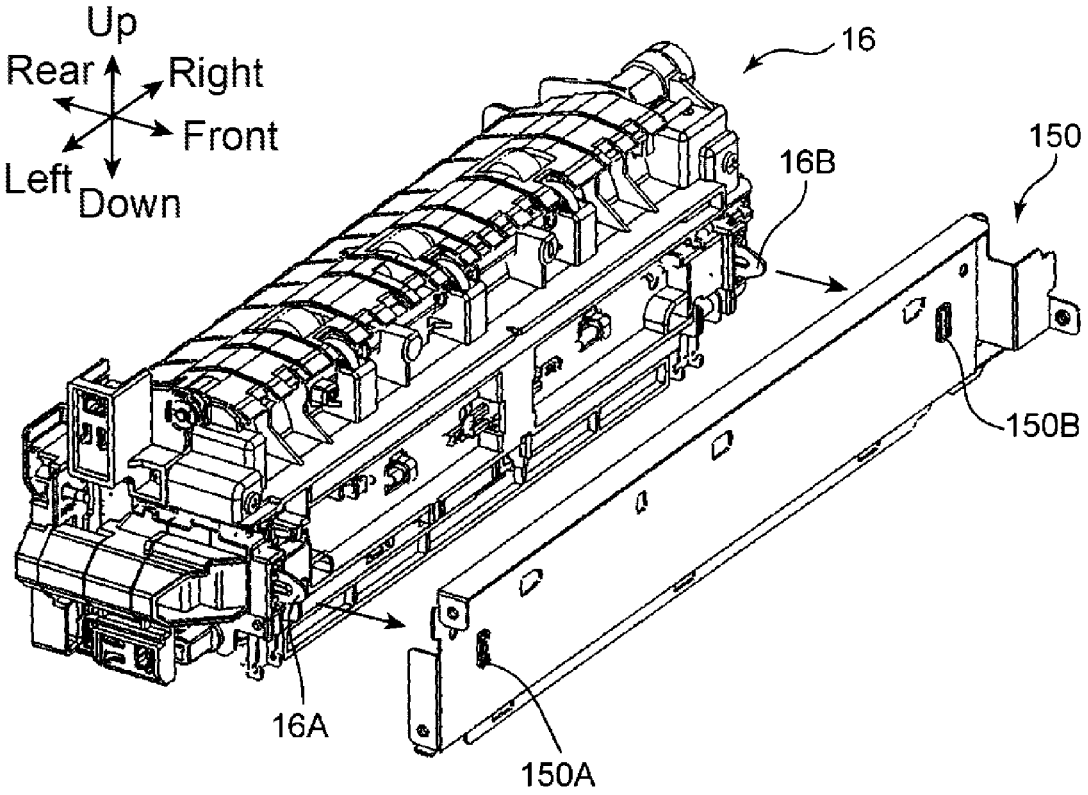
FIG. 10 illustrates a state where the fixing unit according to the one embodiment is mounted to the wall portion.
Figure 11A:
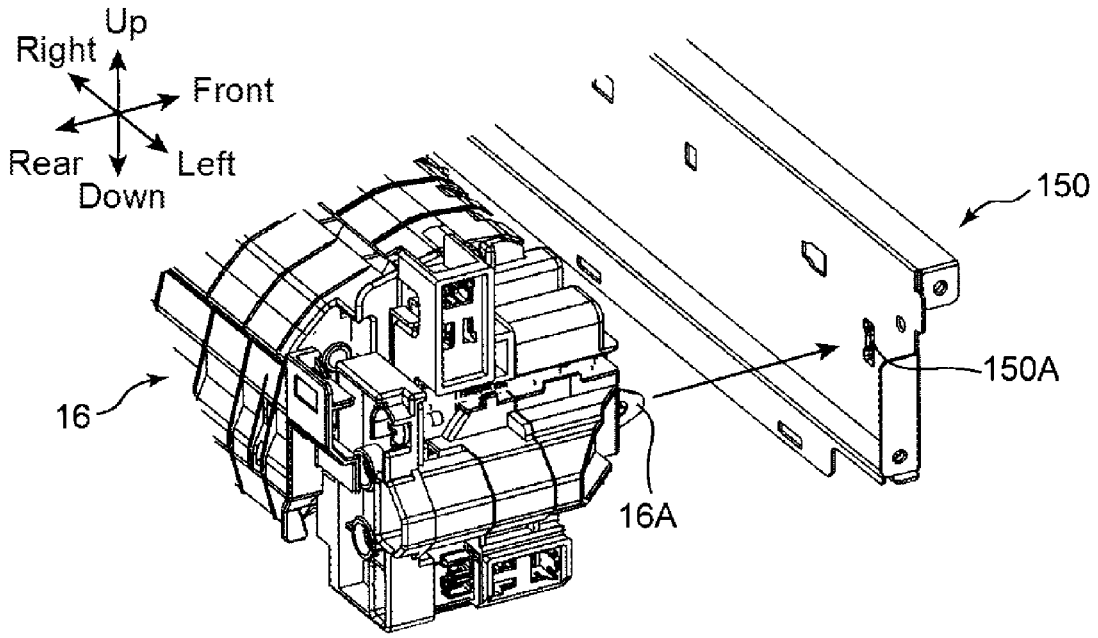
FIGS. 11A and 11B illustrate a part of the enlarged fixing unit and wall portion according to the one embodiment.
Figure 11B:
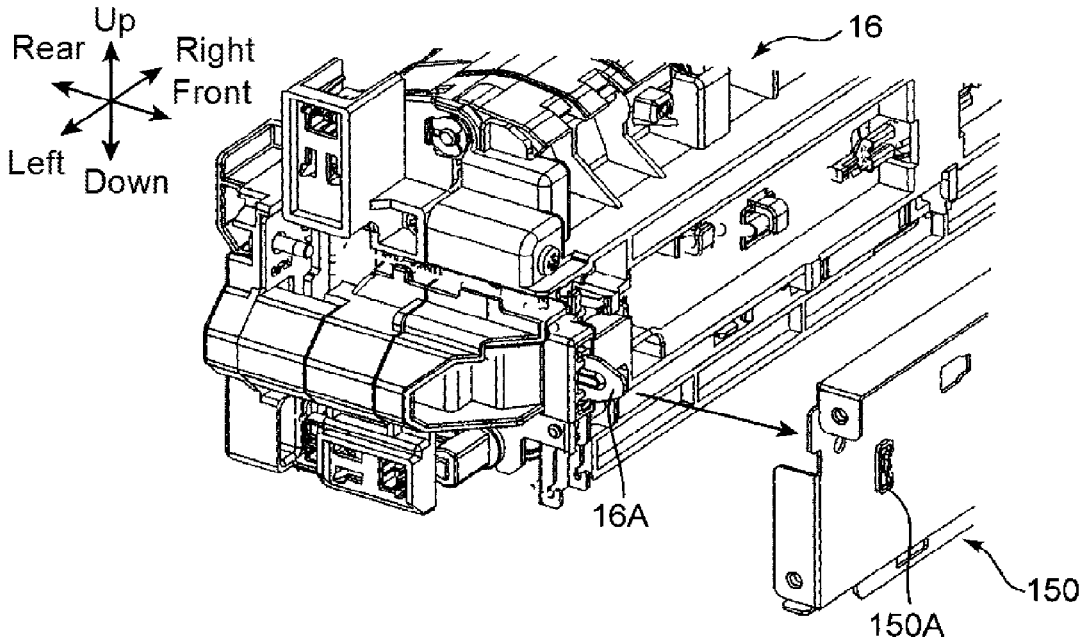
Figure 12:
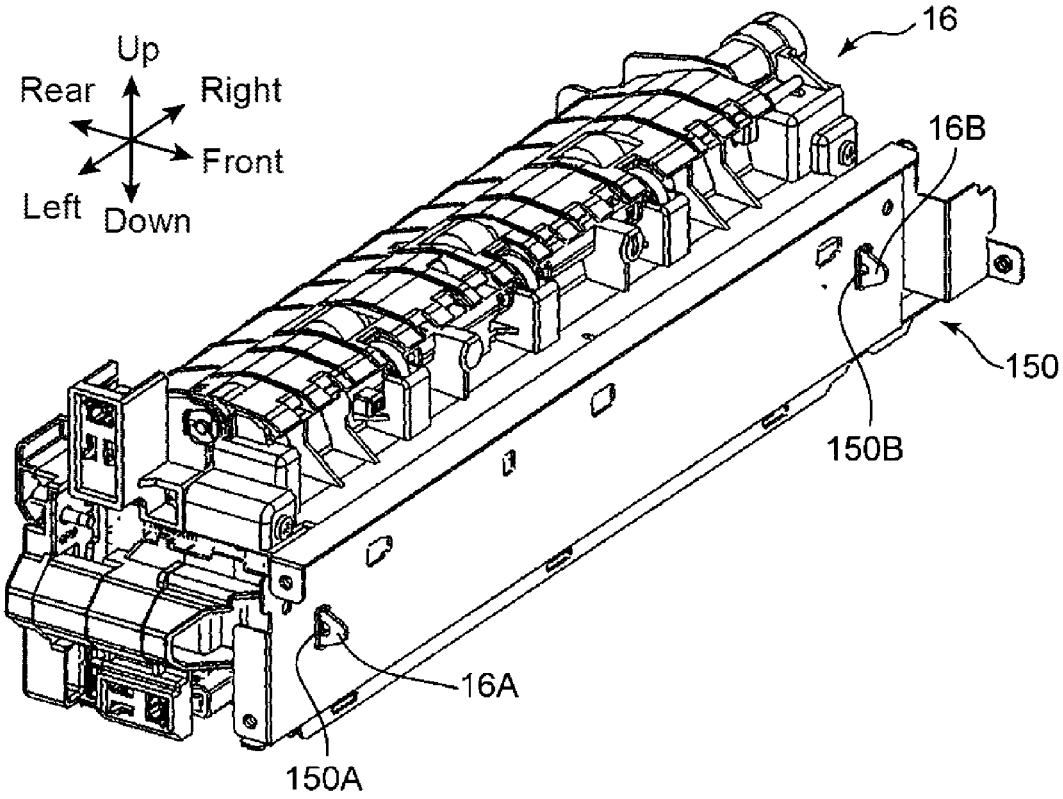
FIG. 12 illustrates a state where the fixing unit according to the one embodiment is mounted to the wall portion.

FIG. 10 illustrates a state where the fixing unit 16 according to the embodiment is mounted to a second plate 150 of the lower chassis 111. FIGS. 11A and 11B illustrate a part of the enlarged fixing unit 16 and second plate 150. FIG. 12 illustrates a state where the fixing unit 16 is mounted to the second plate 150.

The lower chassis 111 includes the second plate 150 (also referred to as a wall portion). The second plate 150 is a wall portion installed in a standing manner opposed to the distal end side of the fixing unit 16 in the mounting direction inside the lower chassis 111. In this embodiment, the second plate 150 is made of the sheet metal member. The second plate 150 includes a third hole 150A (also referred to as a positioning hole) and a fourth hole 150B (also referred to as a positioning hole). The third hole 150A is located on a left end portion of the second plate 150. The third hole 150A is an elongated hole-shaped opening that opens extending in the vertical direction (also referred to as a first direction intersecting with the mounting direction of the fixing unit 16). The third hole 150A has a shape similar to the above-described first hole 110A. The fourth hole 150B is located on the right end portion of the second plate 150. The fourth hole 150B also has a shape similar to the third hole 150A.

The fixing unit 16 includes a third positioning unit 16A (also referred to as a positioning unit) and a fourth positioning unit 16B (also referred to as a positioning unit). The third positioning unit 16A and the fourth positioning unit 16B project from both the end portions of the fixing unit 16 in the lateral direction to the second plate 150. The third positioning unit 16A and the fourth positioning unit 16B have a shape similar to the above-described first positioning unit 10A and second positioning unit 10B. As indicated by the arrows in FIGS. 4 and 10, when the fixing unit 16 is inserted into the lower chassis 111, the third positioning unit 16A is inserted into the third hole 150A and the fourth positioning unit 16B is inserted into the fourth hole 150B. Consequently, at the inside of the lower chassis 111, the position of the fixing unit 16 is regulated in the upper-lower and the lateral directions. Tightening the fixing unit 16 to the second plate 150 with screws (not illustrated) regulates the position of the fixing unit 16 in the front-rear direction. Thus, for the fixing unit 16 as well, the third positioning unit 16A and the fourth positioning unit 16B formed of a part of the sheet metal member achieve stable positioning of the fixing unit 16. Especially, this configuration enhances a rigidity of the third positioning unit 16A and the fourth positioning unit 16B and reduces a cost required for positioning the fixing unit 16.

Details of the image forming apparatus 1 according to the one embodiment of the disclosure is described above. However, this should not be construed in a limiting sense. For example, the disclosure can employ the following modified embodiments.

Figure 13:
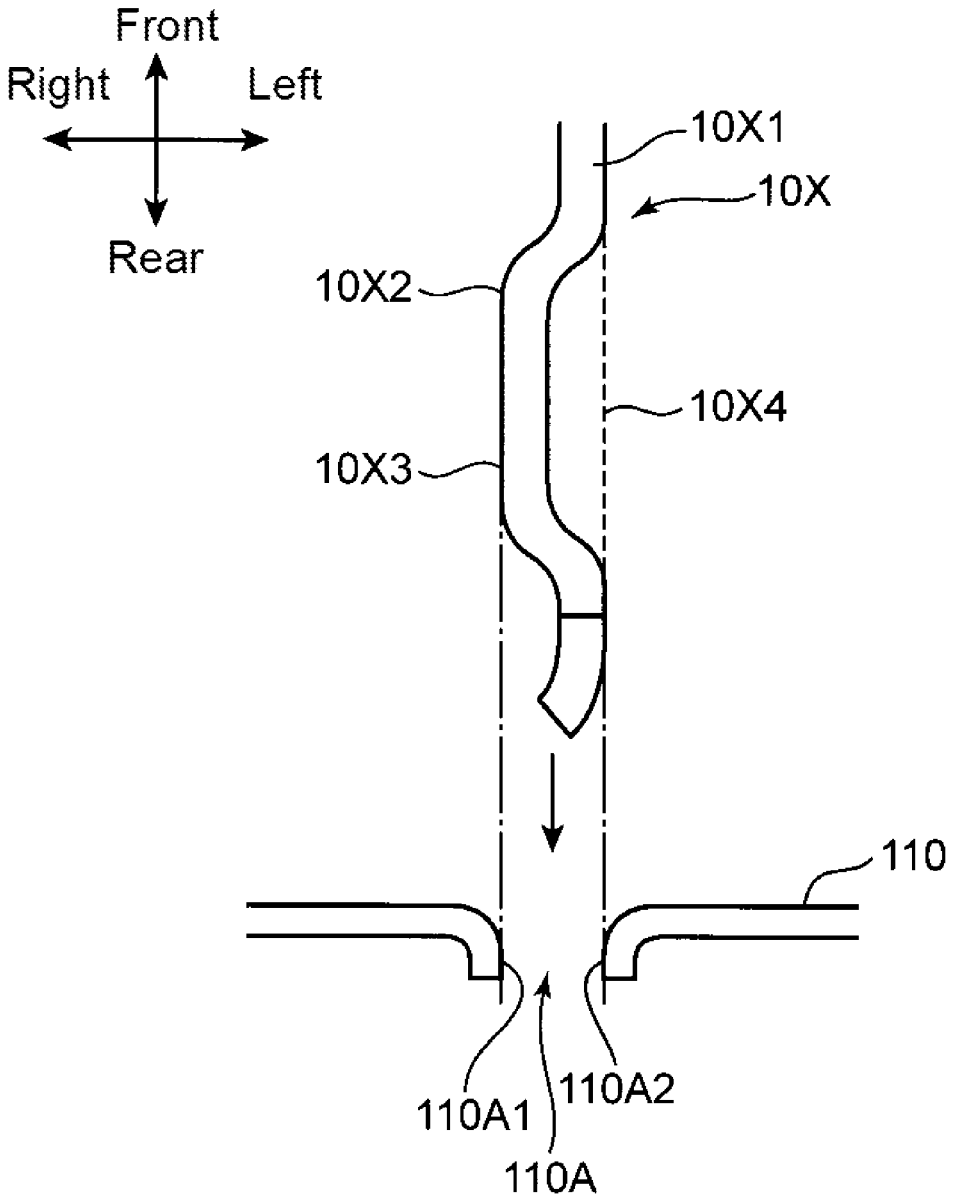
FIG. 13 illustrates a state where a positioning unit of an image forming unit according to another embodiment of the disclosure enters into a positioning hole on a wall portion.

(1) The above-described embodiment describes an aspect where the drawn portion 10R4 of the first positioning unit 10A is formed by the well-known drawing process; however, the disclosure is not limited to this. FIG. 13 illustrates a state where a fifth positioning unit 10X (also referred to as a positioning unit) according to a modified embodiment of the disclosure is inserted into the first hole 110A of the first plate 110. The fifth positioning unit 10X includes a curving portion 10X2 (also referred to as a protrusion) formed by performing a bending process on the part of the projection piece 10X1. A third securing surface 10X3, which is the right-side surface of the curving portion 10X2, is brought in contact with the first side edge 110A1 and a fourth securing surface 10X4, which is the left-side surface of the projection piece 10X1, is brought in contact with the second side edge 110A2. This regulates the position of the fifth positioning unit 10X in the lateral direction. In this case as well, the projection piece 10X1 formed of a part of the thin sheet-shaped sheet metal member achieves stable positioning of the fifth positioning unit 10X.

Figure 14A:
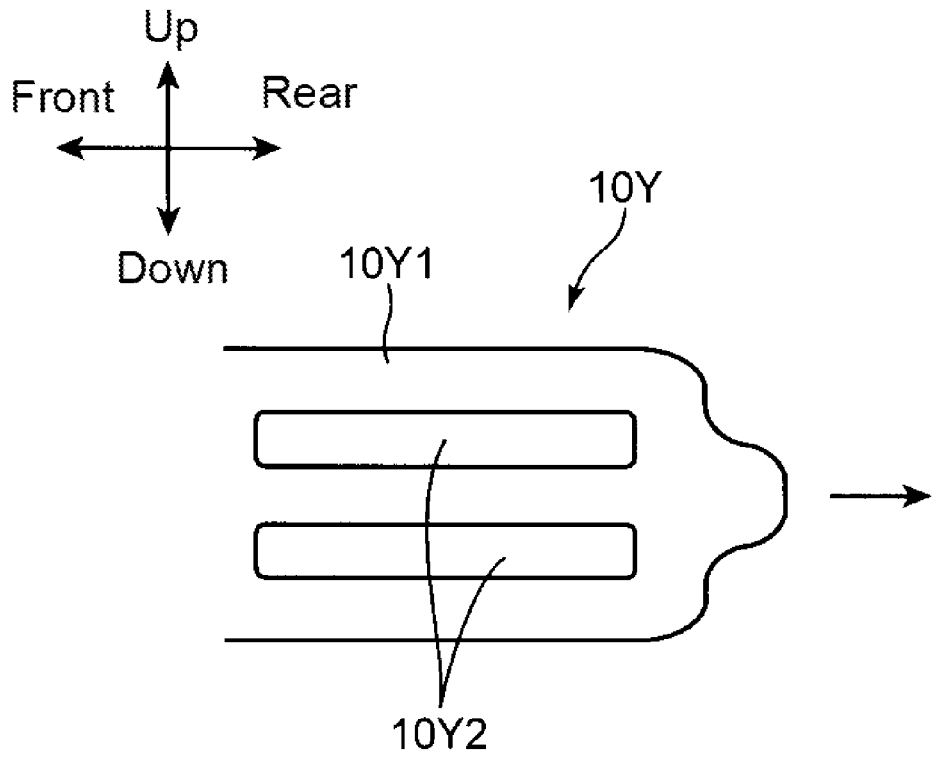
FIGS. 14A and 14B illustrate a side surface of a positioning unit according to a modified embodiment of the disclosure.
Figure 14B:
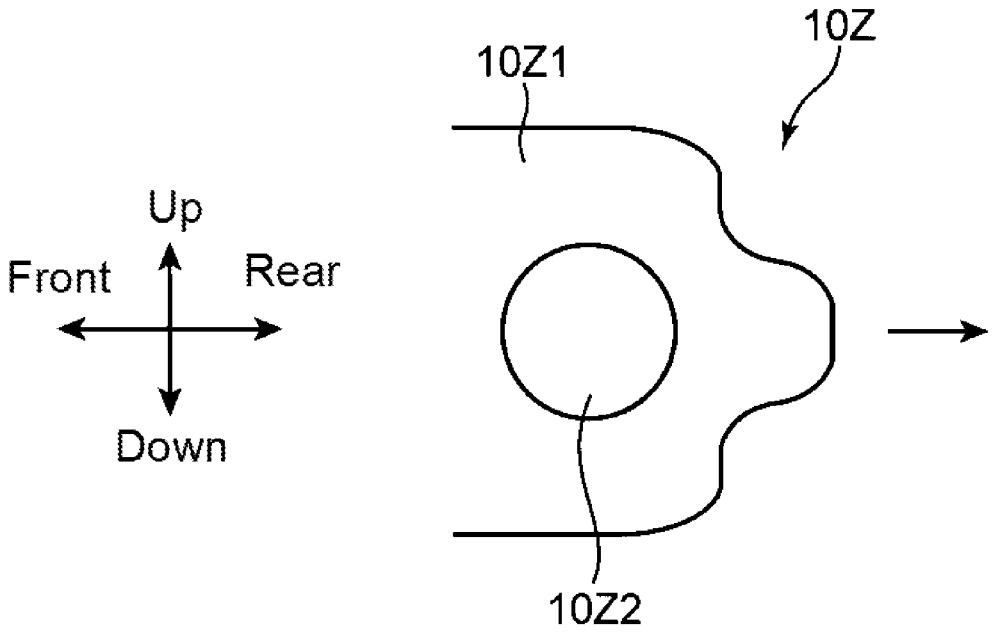

(2) The above-described embodiment describes an aspect where the drawn portion 10R4 of the first positioning unit 10A projects with the approximately oval shape; however, the disclosure is not limited to this. FIG. 14A illustrates a sixth positioning unit 10Y (also referred to as a positioning unit) according to a modified embodiment of the disclosure. The sixth positioning unit 10Y includes a pair of bead portions 10Y2 (also referred to as protrusions), which is formed by processing a part of a projection piece 10Y1, projecting to the right side (also referred to as a front side on the paper of FIG. 14A). The bead portions 10Y2 are formed by performing the well-known bead process on the projection piece 10Y1. In this modified embodiment as well, the right-side surface of the bead portion 10Y2 and the left-side surface of the projection piece 10Y1 abut on the first side edge 110A1 and the second side edge 110A2 illustrated in FIG. 13, respectively. This achieves stably positioning the sixth positioning unit 10Y. FIG. 14B illustrates a seventh positioning unit 10Z according to the modified embodiment of the disclosure (also referred to as a positioning unit). The seventh positioning unit 10Z includes a hemisphere portion 10Z2 (also referred to as a protrusion), which is formed by processing a part of a projection piece 10Z1, projecting to the right side (also referred to as a front side on the paper of FIG. 14B). The hemisphere portion 10Z2 is formed by performing the well-known extrusion process on the projection piece 10Z1. In this modified embodiment as well, the apex of the hemisphere portion 10Z2 and the left-side surface of the projection piece 10Z1 abut on the first side edge 110A1 and the second side edge 110A2 in FIG. 13, respectively. This achieves stably positioning the seventh positioning unit 10Z.

(3) The above-described embodiment describes an aspect where the first plate 110 and the second plate 150 located opposed to the image forming unit 10 and the fixing unit 16 are formed of the sheet metal member; however, the disclosure is not limited to this. As wall portions located opposed to the image forming unit 10 and the fixing unit 16, an aspect where another frame member, block member, or a similar member may be located.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus for forming an image on a sheet, comprising:

an apparatus main body; and a unit mounted to the apparatus main body along a predetermined mounting direction; wherein the apparatus main body includes a wall portion installed in a standing manner opposed to a distal end side of the unit in the mounting direction, the wall portion has a positioning hole and a pair of first inner edges, the positioning hole being open extending in a first direction intersecting with the mounting direction, the first inner edges extending in the first direction and defining both side portions of the positioning hole, the unit includes a sheet metal member and a positioning unit, the sheet metal member including a first surface and a second surface, the first surface extending along the mounting direction, the second surface being located on an opposite side from the first surface, the positioning unit being formed on a distal end side of the sheet metal member in the mounting direction, the positioning unit includes a projection piece and a protrusion, the projection piece being inserted into the positioning hole, the protrusion being formed by deforming the sheet metal member such that the second surface of the projection piece is partially perpendicular to the mounting direction and projects to a second direction, the second direction being perpendicular to the first direction, and when the positioning unit is inserted into the positioning hole, the protrusion and the first surface of the sheet metal member are in contact with the respective pair of first inner edges to regulate a position of the unit in the second direction.

2. The image forming apparatus according to claim 1, wherein a distal end side of the protrusion in the mounting direction is inclined lowering forward along the mounting direction.

3. The image forming apparatus according to claim 1, wherein:

the wall portion has a pair of second inner edges, the second inner edges connecting the respective pair of first inner edges, the second inner edges defining both end portions of the positioning hole in the first direction;

the projection piece of the positioning unit includes a pair of outer edges, the outer edges being located providing a space in the first direction, the outer edges each extending along the mounting direction; and the outer edges of the projection piece are in contact with the second inner edges of the positioning hole to regulate the position of the unit in the first direction.

4. The image forming apparatus according to claim 3, wherein the projection piece is located at a distal end side of the outer edges in the mounting direction, the projection piece including an inclined portion, the inclined portion being inclined such that the projection piece being tapered along the mounting direction.

5. The image forming apparatus according to claim 3, wherein one of the first inner edges and the second inner edges is bent toward a distal end side in the mounting direction.

6. The image forming apparatus according to claim 1, wherein:

the positioning unit includes a distal end protrusion located on a distal end portion of the projection piece in the mounting direction; and the distal end protrusion is curved such that the first surface of the sheet metal member warps toward the second surface side.

7. The image forming apparatus according to claim 1, wherein the first inner edges are bent toward a distal end side in the mounting direction.

8. The image forming apparatus according to claim 1, wherein the unit is an image forming unit that forms an image in the apparatus main body.

9. The image forming apparatus according to claim 8, wherein:

the image forming unit includes a photoreceptor drum, an electrostatic latent image being formed on a surface of the photoreceptor drum, the photoreceptor drum supporting a developer; and the photoreceptor drum is rotatably supported by the sheet metal member.

10. The image forming apparatus according to claim 1, wherein the unit is a fixing unit that performs a fixing process on an image transferred onto a sheet in the apparatus main body.

* * * * *